US007427203B2

(12) United States Patent
Liao

(10) Patent No.: US 7,427,203 B2
(45) Date of Patent: Sep. 23, 2008

(54) LAND GRID ARRAY SOCKET

(75) Inventor: Fang-Jwu Liao, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/646,926

(22) Filed: Dec. 27, 2006

(65) Prior Publication Data

US 2007/0149002 A1 Jun. 28, 2007

(30) Foreign Application Priority Data

Dec. 27, 2005 (CN) ..... 2005 1 0134942

(51) Int. Cl.
*H01R 12/00* (2006.01)

(52) U.S. Cl. ..... 439/66

(58) Field of Classification Search ..... 439/66, 439/69–73, 342

See application file for complete search history.

(56) References Cited

U.S. PATENT DOCUMENTS 5,139,427 A * 8/1992 Boyd et al. ..... 439/66
6,186,797 B1 2/2001 Wang et al.
6,488,513 B1 12/2002 Neidich et al.
6,638,119 B1 * 10/2003 Chang ..... 439/857
6,843,659 B2 1/2005 Liao et al.

FOREIGN PATENT DOCUMENTS

TW M274681 9/2005

* cited by examiner

*Primary Examiner*—Ross N Gushi
(74) *Attorney, Agent, or Firm*—Wei Te Chung

(57) ABSTRACT

According to one embodiment of the present invention, a land grid array socket includes an insulative housing (30) defining a number of passages (35) and a number of conductive terminals (20) residing in corresponding passages, respectively. Each terminal includes a base section (21) secured in the passage and a pair of opposing bent sections (23, 24) angularly stretching out from two sides of the base section. The bent sections each include a pair of resilient arms (25) protruding upwardly out of the housing, so as to provide multiple contacting points between the terminal and an electronic component seated thereon.

12 Claims, 4 Drawing Sheets

LAND GRID ARRAY SOCKET

BACKGROUND OF THE INVENTION

1. Field of the Invention

The present invention generally relates to the field of electrical connectors. And more particularly, one embodiment of the present invention relates to a land grid array socket for forming reliable electrical connection between a land grid array package and a circuit substrate.

2. General Background

Land grid array sockets are widely used in various electrical devices to form electrical connection between a land grid array package and a circuit substrate. Basically, a land grid array socket includes an insulative housing defining a number of passages and a number of conductive terminals residing in corresponding passages, respectively. Each conductive terminal includes a resilient arm sticking out of the housing, to mate with a grid array package. In use, under compression of the land grid array package, the resilient arm is deflected from its natural position and elastically abuts against the land grid array package, thereby forming electrical engagement between the land grid array package and the conductive terminal.

The materials set forth in connection with this U.S. patent application describe an electrical connector and associated conductive terminals—see e.g., U.S. Pat. Nos. 6,186,797, 6,488,513 and 6,843,659, which are all hereby incorporated by reference.

As shown in FIG. 1, which is generally FIG. 3 of U.S. Pat. No. 6,843,659, the conductive terminal 1 includes a planar connection portion 14 and a first spring arm 10 extending upwardly from the connection portion 14, to elastically mate with the land grid array package. However, in this prior design, there is only one contacting point 101 on the first spring arm 10. When the conductive terminal is biased from its normal position in the housing 2, electrical connection between the conductive terminal and the land grid array package possibly cannot be ensured.

Therefore, there is a heretofore unaddressed need in the industry to address the aforementioned deficiencies and inadequacies.

SUMMARY

According to an embodiment of the present invention, a land grid array socket includes an insulative housing defining a number of passages and a number of conductive terminals residing in corresponding passages, respectively. Each terminal includes a base section secured in the passage and a pair of opposing bent sections angularly stretching out from opposite lateral sides of the base section. The bent sections each include a pair of resilient arms protruding upwardly out of the housing, to provide multiple contacting points between the terminal and an electronic component seated thereon.

The embodiment of the present invention provides a land grid array socket embedded with a number of conductive terminals each having a number of resilient arms. The arrangement of the resilient arms can provide multiple contacting points between the land grid array package and the conductive terminal, even though the conductive terminal may be biased from its normal position.

The present invention is illustrated by way of example and not limitation in the figures of the appended drawings, in which like references indicate identical elements, and in which:

DETAILED DESCRIPTION OF THE EMBODIMENT

In the following description, for purpose of explanation, numerous details are set forth in order to provide a thorough understanding of the embodiment of the present invention. However, it will be apparent to one skilled in the art that these specific details are not required in order to practice the embodiment of the present invention.

Figure 1:
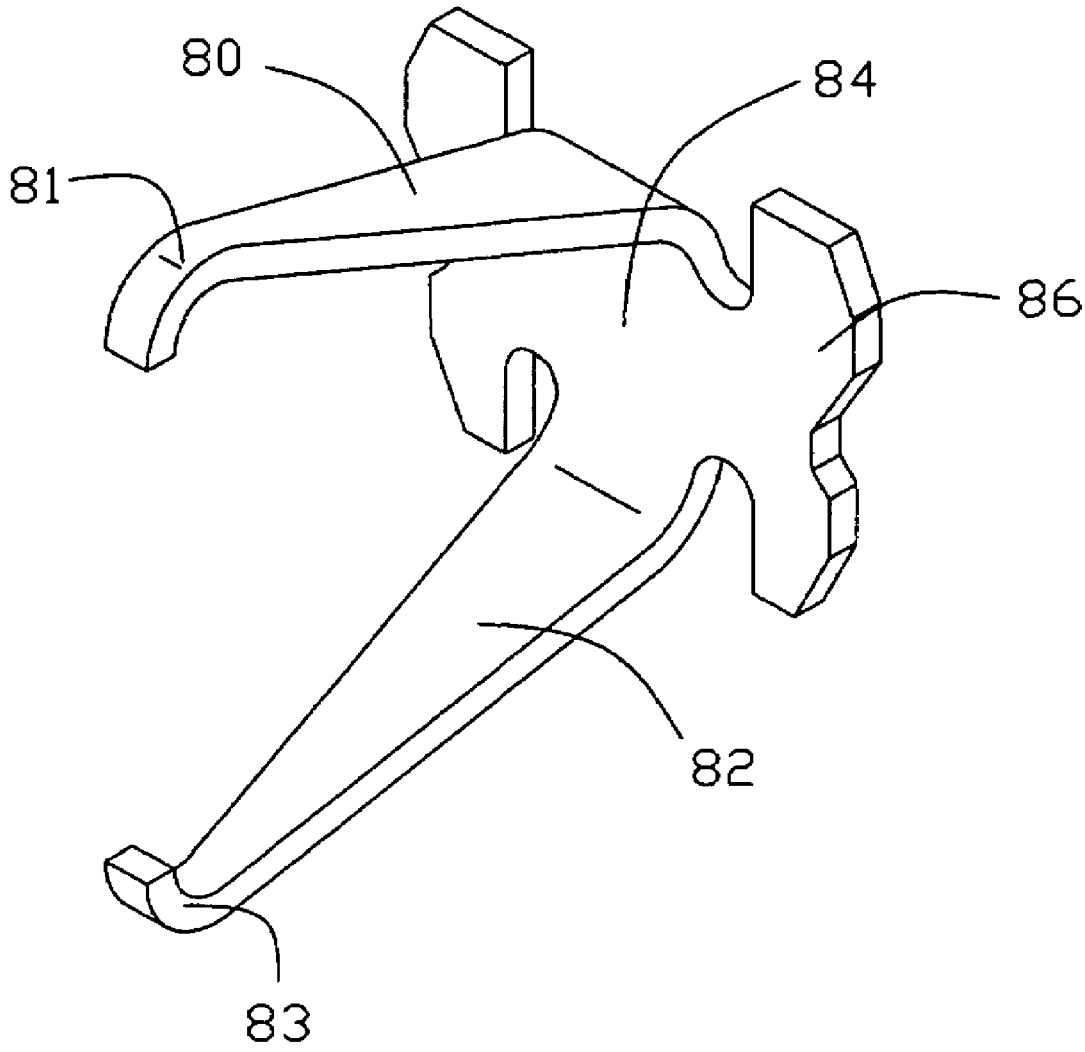
FIG. 1 (Prior Art)
FIG. 1 depicts an exemplary isometric view of a conductive terminal for a prior art land grid array socket.
Figure 2:
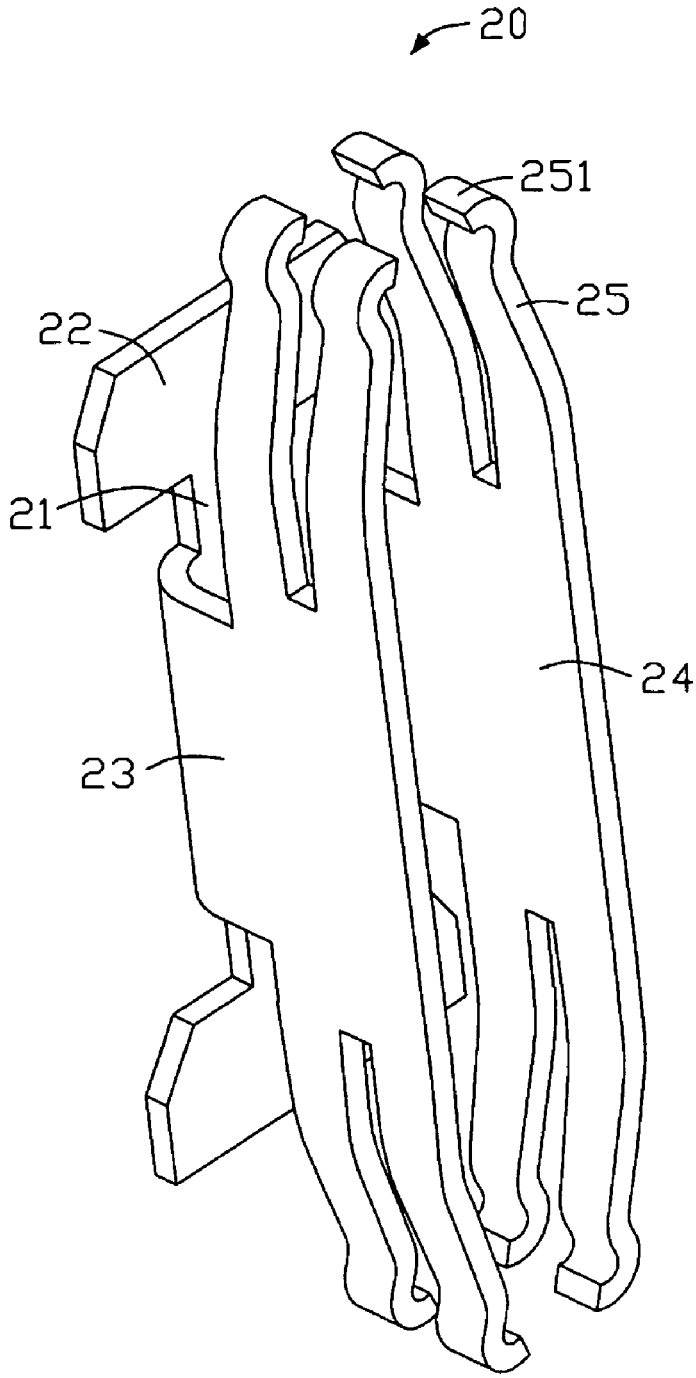
FIG. 2 depicts an exemplary isometric view of a conductive terminal for a land grid array socket according to one embodiment of the present invention.
Figure 3:
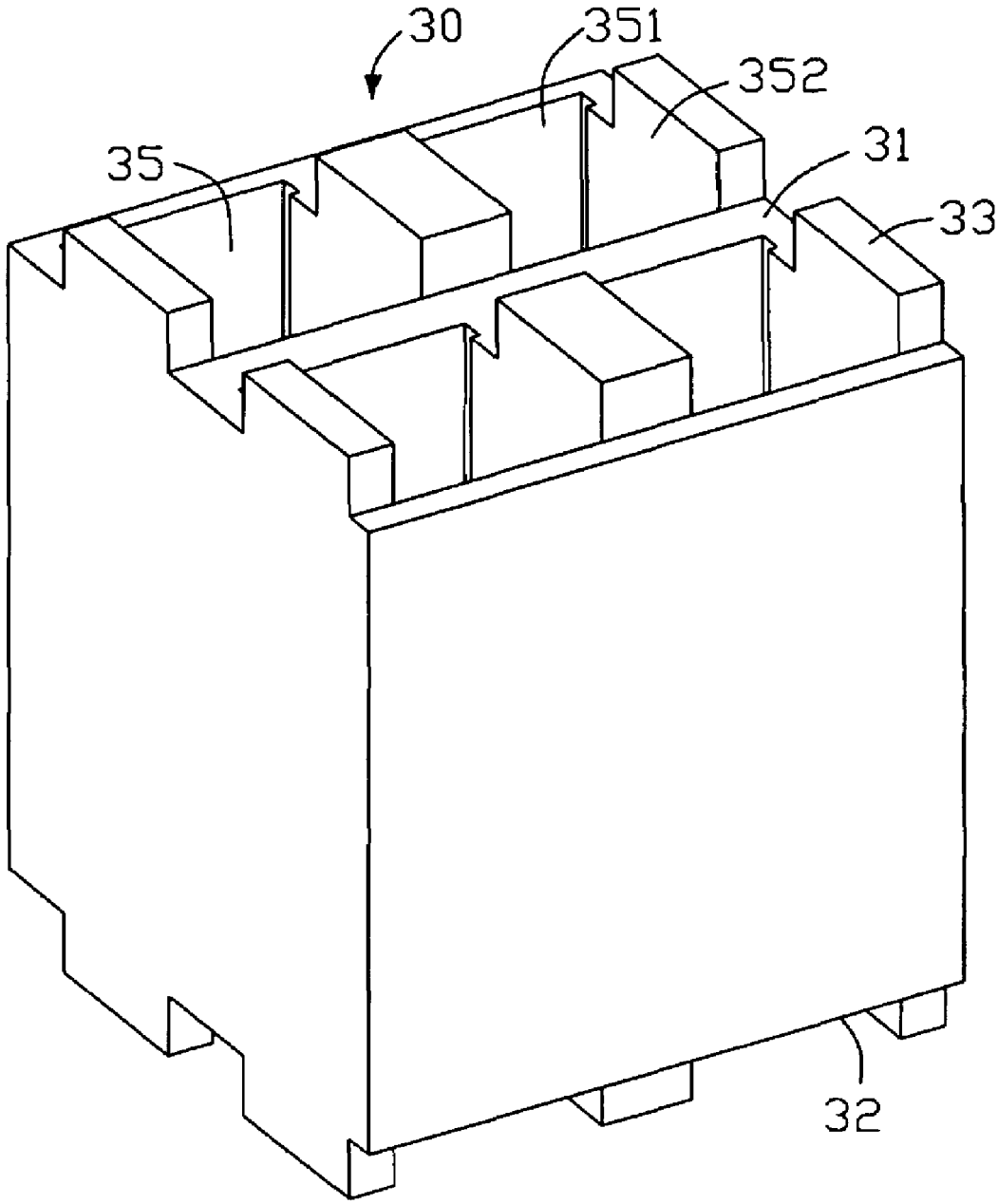
FIG. 3 depicts an exemplary isometric view of an electrically insulating housing for receiving the conductive terminal of FIG. 2, to put it simple, only a part of the housing is illustrated.
Figure 4:
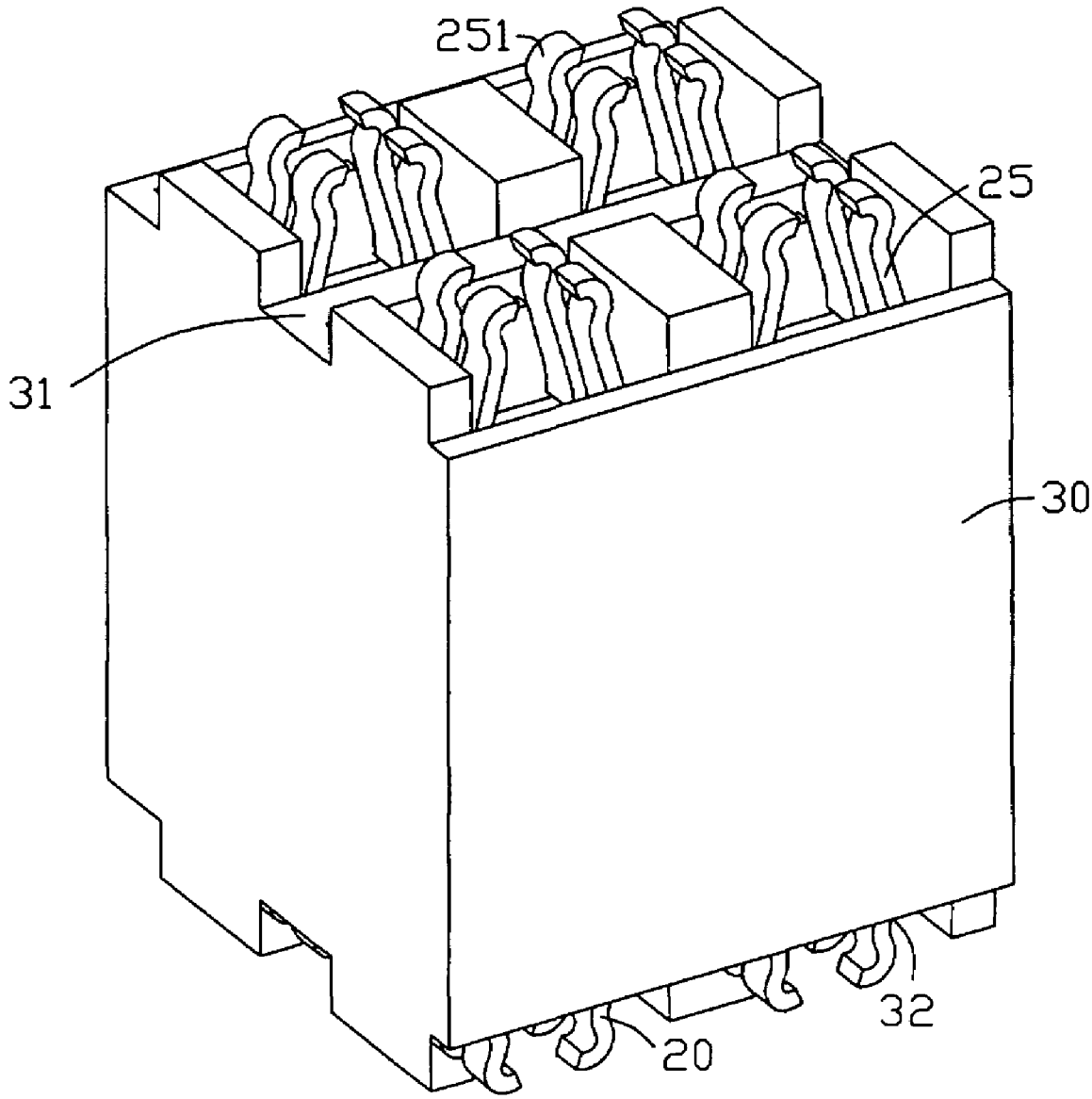
FIG. 4 depicts an exemplary isometric, assembled view of the land grid array socket, showing the terminals of FIG. 2 residing in corresponding passages defined in the housing of FIG. 3, respectively.

Referring to FIG. 2 to FIG. 4, a land grid array socket in accordance with an embodiment of the present invention includes an insulative housing 30 defining a number of passages 35 and a number of conductive terminals 20 seated in corresponding passages 35, respectively.

Individual elements of the land grid array socket will now be described in greater detail. As shown in FIG. 3, the housing 30 includes an upper surface 31, a lower surface 32, and a number of passages 35 extending throughout the upper surface 31 and the lower surface 32. Each passage 35 includes a narrow retaining slot 351 and a wide receiving slot 352 in communication with each other. In an alternative form of the present invention, the housing 30 is preferably provided with a number of stand-offs 33 projecting from the upper surface 31 thereof.

As shown in FIG. 2, the conductive terminal 20 includes a vertically oriented base section 21 and a pair of opposing bent sections 23, 24 angularly stretching out from two lateral sides of the base section 21. The bent sections 23, 24 each have a pair of resilient arms 25 extending upwardly and obliquely towards each other. Each resilient arm 25 forms an arched contacting section 251 at a distal end thereof. In an alternative form of the present invention, the base section 21 is preferably provided with a number of retention blocks 22 at an upper side and a lower side thereof, respectively, for creating stable frictional interference with the side walls of the passage 35.

When the terminal 20 is inserted in the passages 35, the base section 21 of the terminal 20 is positioned in the narrow slot 351, with the retention blocks 22 thereof interferingly engaging with side walls of the narrow slot 351. The bent sections 23, 24 reside in the wide receiving slot 352 and are spaced from the side walls of the receiving slot 352. The resilient arms 25 stick upwardly and obliquely with respect to the upper surface 31 of the housing 30 to a same distance, to electrically mate with a land grid array package (not shown) placed thereon.

In connection with the preceding description, the conductive terminal 20 in accordance with the embodiment of the present invention can provide multiple contacting points to mate with the land grid array package placed thereon, thereby ensuring reliable electrical connection between the conductive terminal 20 and the land grid array package even in the presence of deflection of the terminal 20.

It should be noted that, as is known in the art, the conductive terminal 20 can be coupled to the circuit substrate via various means known to one ordinary skilled in the art, for instance via a soldering pad, or via a pin, or via a number of spring arms as recited in the preceding description. In addition, in the present embodiment, each bent section 23, 24 are formed with a pair of resilient arms 25. In another form of the present invention, the bent sections 23, 24 each can also be formed with one resilient arm. Or alternatively, one bent section 23 is formed with a resilient arm, and the other bent section 24 is formed with a pair of resilient arms.

While the present invention has been illustrated by description of embodiment thereof, and while the embodiment have been described in considerable detail, it is not intended to restrict or in any way limit the scope of the appended claims to such details. Additional advantages and modifications in the spirit and scope of the present invention will readily appear to one skilled in the art. Therefore, the present invention is not limited to the specific details and illustrative examples shown and described.

The invention claimed is:

1. A land grid array socket, comprising:

an insulative housing defining a plurality of passages extending between an upper surface and a lower surface thereof; and each passage including a narrow retaining slot and a wide receiving slot in communication with each other; and a plurality of conductive terminals residing in corresponding passages, respectively, each terminal comprising a vertically oriented base section secured in the passage and a pair of opposing bent sections angled with respect to the base section and in a parallel relation with each other, the bent sections each formed with at least one slender resilient arm protruding upwardly and downwardly out of the upper and the lower surface of the housing to provide multiple contacting points at a distal end thereof and each contacting point separate with each other;

wherein each bent section of the terminal is spaced from the side walls of the passage.

2. The land grid array socket of claim 1, wherein the at least one resilient arm of the terminal extends upwardly and obliquely from an upper side of the bent section.

3. The land grid array socket of claim 1, wherein the resilient arms of the opposing bent sections of the terminal extend toward each other.

4. The land grid array socket of claim 1, wherein the base section of the terminal is secured in the narrow retaining slot, and the bent sections of the terminal extend to and reside in the wide receiving slot.

5. The land grid array socket of claim 1, wherein the housing is provided with a plurality of stand-offs projecting from the upper surface or a lower surface thereof.

6. The land grid array socket of claim 1, wherein each resilient arm of the terminal is formed with an arched contacting section at a distal end thereof.

7. The land grid array socket of claim 6, wherein the contacting sections each extend to a same distance with respect to the upper surface of the housing.

8. A conductive terminal, comprising:

a vertically oriented base section and defining retention blocks at an upper end and a lower end thereof; and a pair of opposing bent sections angularly stretching out from two lateral sides of the base section and in a parallel relation with each other, the bent sections each having at least one slender resilient arm extending upwardly and downwardly and each resilient arm defining at least one contacting point separate with each other and obliquely to establish reliable electrical and mechanical engagement with an electronic component placed thereon.

9. The terminal of claim 8, wherein the resilient arms each forms an arched contacting section at a distal end thereof.

10. The terminal of claim 8, wherein the resilient arms of the opposing bent sections extend toward each other.

11. The terminal of claim 10, wherein distal ends of the resilient arms are spaced from each other.

12. A land grid array socket, comprising:

an insulative housing defining at least a row of passages extending between an upper surface and a lower surface thereof; and a plurality of conductive terminals residing in corresponding passages, respectively, each terminal comprising a base section secured in the passage and defining a first plane, and a pair of opposing bent sections angled with respect to the base section and defining a pair of opposite second and third planes in a parallel relation with and spaced, in a lateral direction, from each other, each of the bent sections forming at least one resilient arm protruding upwardly out of the upper surface of the housing so as to provide two rows multiple contacting points between the terminal and an electronic component seated thereon; wherein each of said bent sections defines two said resilient arms, spaced from each other along a direction of the row of passageways.

* * * * *